United States Patent [19]

Weigl, deceased

[11] Patent Number: 4,509,850

[45] Date of Patent: Apr. 9, 1985

[54] TWO-COLOR ELECTROPHOTOGRAPHIC PRINTING MACHINE

[75] Inventor: John W. Weigl, deceased, late of Webster, N.Y., by Etta R. Weigl, executor

[73] Assignee: Xerox Corporation, Stamford, Conn.

[21] Appl. No.: 520,971

[22] Filed: Aug. 8, 1983

[51] Int. Cl.[3] ..... G03G 15/01

[52] U.S. Cl. ..... 355/4; 355/3 DD

[58] Field of Search ..... 355/4, 7, 14 E; 430/42, 430/47, 46, 44

[56] References Cited

U.S. PATENT DOCUMENTS

| | | | |
|---|---|---|---|
| 3,702,483 | 11/1972 | Fautuzzo | 355/4 |
| 3,832,170 | 8/1974 | Nagamatsu | 96/1.2 |
| 4,078,929 | 3/1978 | Gundlach | 96/1.2 |
| 4,189,224 | 2/1980 | Sakai | 355/4 |
| 4,264,185 | 4/1981 | Ohta | 355/4 |
| 4,289,837 | 9/1981 | Gundlach | 355/3 DD |
| 4,335,194 | 6/1982 | Sakai | 430/42 |
| 4,387,983 | 6/1983 | Masegi | 355/14 E |

*Primary Examiner*—A. T. Grimley
*Assistant Examiner*—David Warren
*Attorney, Agent, or Firm*—H. Fleischer; J. E. Beck; R. Zibelli

[57] ABSTRACT

An electrophotographic printing machine in which a latent image is recorded on a photoconductive surface with modulated and continuously charged regions. The modulated regions are developed with polar or polarizable marking particles with the continuously charged regions being developed with charged marking particles. The charged marking particles and polar or polarizable marking particles are different colors. Both types of marking particles are transferred simultaneously to a copy sheet and subsequently permanently affixed thereto forming a two-color copy.

12 Claims, 4 Drawing Figures

TWO-COLOR ELECTROPHOTOGRAPHIC PRINTING MACHINE

This invention relates generally to an electrophotographic printing machine, and more particularly concerns a printing machine which reproduces information in two different colors.

In the process of electrophotographic printing, a photoconductive surface is charged to a substantially uniform level. The photoconductive surface is imagewise exposed to record an electrostatic latent image corresponding to the informational areas of an original document being reproduced. Thereafter, developer mixture is transported into contact with the electrostatic latent image. Toner particles are attracted from the carrier granules of the developer mixture onto the latent image. The resultant toner powder image is then transferred from the photoconductive surface to a copy sheet and permanently affixed thereto.

Recently, multicolor electrophotographic printing machines have been developed. Printing machines of this type utilize a plurality of developer units in which each developer unit contains discretely colored toner particles. The light image of the colored original document is optically filtered to form a single color light image. This single color light image creates a single color electrostatic latent image on the photoconductive surface. The single color electrostatic latent image is then developed with toner particles of a color complementary in color to the color of the filtered light image. In this way, three single color toner powder images are successively developed on the photoconductive surface. Each single color toner powder image corresponds to the complement of one of the colors of the information contained in the original document. These toner powder images are successively transferred to the copy sheet in superimposed registration with one another to form a multicolor copy corresponding to the original document being reproduced. Thereafter, the composite toner powder image is permanently affixed to the copy sheet.

In the business office environment, it is frequently desirable to reproduce copies at a high speed. Heretofore, the color copier required three cycles to reproduce one copy. Thus, the copying machine was one-third as fast as a black and white copier. Original documents frequently contain highlighted portions, i.e. the original document has information in black and red. It is highly desirable for the electrophotographic printing machine to reproduce both the black information and the red information in a single pass. Printing machines of this type are capable of operating at the same speed as conventional black and white machines. The printing machine forms a color copy in a single pass. By single pass, it is meant that a composite electrostatic latent image having regions corresponding to the red information and black information is recorded on the photoconductive surface. This composite electrostatic latent image is developed with black and red toner particles to produce a two-color toner powder image. This two-color powder image is subsequently transferred to the copy sheet and permanently affixed thereto. In this way, a highlighted color copy of the original document may be readily produced at relatively high speeds. Numerous approaches have been devised for producing color copies. The following disclosures appear to be relevant:

U.S. Pat. No. 3,832,170; Patentee: Nagamatsu et al.; Issued: Aug. 27, 1974.

U.S. Pat. No. 4,078,929; Patentee: Gundlach; Issued: Mar. 14, 1978.

U.S. Pat. No. 4,189,224; Patentee: Sakai; Issued: Feb. 19, 1980.

U.S. Pat. No. 4,264,185; Patentee: Ohta; Issued: Apr. 28, 1981.

U.S. Pat. No. 4,335,194; Patentee: Sakai; Issued: June 15, 1982.

The relevant portions of the above-identified disclosures may be summarized as follows:

Nagamatsu et al. describes a photosensitive member having an insulating layer acting as a color filter. The photoconductive drum is divided into three segments, each segment corresponds to a different color. The drum is charged and exposed to a light image from the original document. Each segment has recorded thereon a different colored electrostatic latent image. These differently colored electrostatic latent images are then developed by toner particles complementary in color thereto. The toner powder images are then transferred to a copy sheet in superimposed registration to form a multicolor copy corresponding to the original document.

Gundlach discloses an electrophotographic printing machine in which a charge pattern is recorded on a photoconductive surface having positive and negative regions. Toner particles which are positively and negatively charged with respect to one another are used to develop the respective regions of the charge pattern. The toner particles are of different colors. Both the negatively and positively charged toner particles are simultaneously transferred to a copy sheet forming a two-color copy of the original document.

Sakai, U.S. Pat. No. 4,189,224, discloses a photoconductive drum formed with first and second photoconductive layers of different spectral sensitivities. The photoconductive drum is charged and exposed causing electrostatic latent images to be formed on the respective layers according to the color within the original document. The charges of the latent images are of opposite polarity. Toner particles, similarly of opposite polarity, are used to develop the respective latent images. The toner particles are of different colors. In this way, a two-color copy is formed.

Ohta describes an electrophotographic printing machine employing a photoconductive drum formed with at least two photoconductive layers of different spectral sensitivities. One layer may be panchromatic with the other layer being insensitive to red light. The drum is charged, at least twice, with opposite polarities to produce the stratified charge pattern. A light image of the original document then exposes the charged regions of the drum. This results in positive and negative electrostatic latent images being recorded thereon. The latent images are developed with black and red toner particles of opposite polarity to form a two-color copy.

Sakai, U.S. Pat. No. 4,335,194, discloses a photoconductive member comprising a red sensitive photoconductive layer and a red insensitive photoconductive layer. Two colors are printed by charging and exposing to white light, irradiating with red light and charging to an opposite polarity, charging to the same polarity as the first polarity, and developing with red and black toners of opposite polarity.

In accordance with one aspect of the features of the present invention, there is provided an electrophotographic printing machine of the type having a photoconductive member. Means record a modulated charged area and a continuously charged area on the surface of the photoconductive member. Means are provided for developing the modulated charged area on the surface of the photoconductive member with polar or polarizable marking particles and the continuously charged area on the surface of the photoconductive member with charged marking particles.

Pursuant to another aspect of the features of the present invention, there is provided a method of electrophotographic printing including the steps of recording a modulated charged area and a continuously charged area on the surface of the photoconductive member. The modulated charged area is developed with polar or polarizable marking particles. The continuously charged area on the surface of the photoconductive member is developed with charged marking particles.

Other aspects of the present invention will become apparent as the following description proceeds and upon reference to the drawings, in which.

While the present invention will hereinafter be described in conjunction with a preferred embodiment and method of use, it will be understood that it is not intended to limit the invention to that embodiment or method of use. On the contrary, it is intended to cover all alternatives, modifications and equivalents as may be included in the spirit and scope of the invention as defined by the appended claims.

Figure 1:
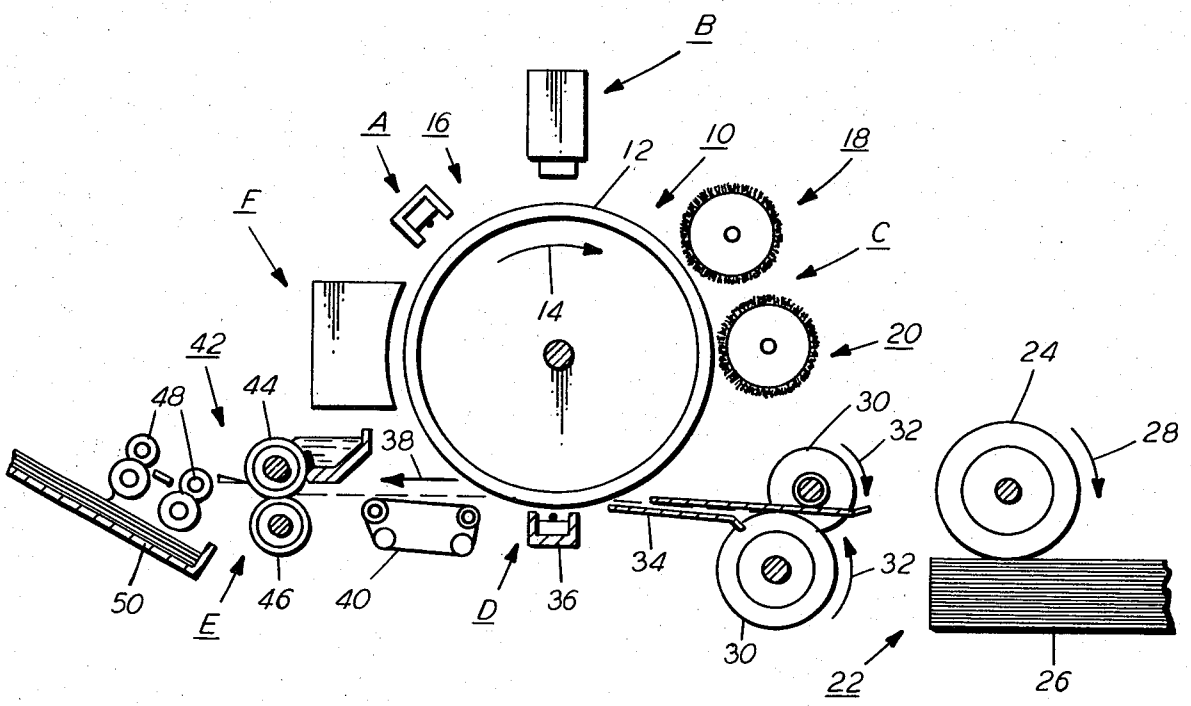
FIG. 1 is a schematic elevational view showing an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the features of the present invention therein. It will become evident from the following discussion that the apparatus of the present invention is equally well suited for use in a wide variety of electrostatographic printing machines and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a drum 10 having a photoconductive surface 12 adhering to a conductive substrate. By way of example, photoconductive surface 12 is made from a selenium alloy with the conductive substrate being made from aluminum. Drum 10 moves in the direction of arrow 14 to advance successive portions of photoconductive surface 12 sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high, substantially uniform potential.

Next, the charged portion of photoconductive surface 12 is advanced through imaging station B. Imaging station B irradiates the charged portion of photoconductive surface 12 to selectively dissipate the charge thereon forming modulated charged areas and continuously charged areas on photoconductive surface 12. Various embodiments of exposure station B and the manner in which the modulated charged areas and the continuously charged areas are recorded on photoconductive surface 12 will be described hereinafter with reference to FIGS. 2 through 4, inclusive. After the continuously charged areas and modulated charged areas have been recorded on photoconductive surface 12, drum 10 advances these regions, in the direction of arrow 14, to development station C. Development station C includes developer rollers 18 and 20. Developer roller 18 transports polar or polarizable marking particles into contact with the charge pattern recorded on photoconductive surface 12. The polar or polarizable marking particles are attracted to the modulated charge pattern. Developer roller 20 transports charged marking particles into contact with the charge pattern recorded on photoconductive surface 12. The continuously charged area attracts the charged particles thereto. Thus, the continuously charged area of the charge pattern attracts the charged particles with the modulated charged area of the charge pattern attracting the polar or polarizable marking particles. Preferably, the polar or polarizable marking particles are black with the charged particles being red. In this way, the charge pattern is developed simultaneously with red and black marking particles. Generally, the polar or polarizable marking particles must, in the presence of field gradients, become polarized. Where the charge pattern is non-uniform, i.e. modulated, these polar or polarizable particles are attracted thereto because of this characteristic. The polar or polarizable marking particles should be of a material having a dielectric constant greater than 2 and a bulk resistivity of at least $10^{11}$ ohm-cm and preferably greater than about $10^{12}$ ohm-cm. Any suitable resinous material having these characteristics and capable of being fixed to the copy sheet can be employed, such as, for example polyvinyl copolymers such as polyvinylacetate, polyvinylbutyl and the like; polystyrene and copolymers thereof, polyolefins, such as polyethylene, polypropylene and the like; acrylates such as polymethylacrylate, polymethylmethylacrylate, polymethylacrylic acid, copolymers thereof and the like; polycarbonates, polyester resins, epoxy resins and the like. The polar or polarizable marking particles may have any suitable shape including spherical, oval, granular, etc. and have a particle size of from about 5 to about 50 microns, preferably about 10 to about 35 microns, and preferably from about 15 to about 30 microns. Preferably, developer roller 18 includes an insulating cylinder which is rotatable with respect to a cylinder positioned interiorly thereof. The interior cylinder has interdigited electrodes positioned on the surface thereof. A voltage supply electrically biases alternate electrodes in order to establish between adjacent electrodes a suitable voltage difference to achieve the desired fields. Suitable voltage ranging from a negative 3000 volts to a positive 3000 volts may be employed. A suitable developer roller and polar or polarizable marking particles are described, in greater detail, in U.S. Pat. No. 4,289,837 issued to Gundlach on Sept. 15, 1981, the relevant portions thereof being hereby incorporated into the present application.

Developer roller 20 is a conventional magnetic brush developer roller. This type of roller uses an non-magnetic rotating sleeve having a stationary magnet disposed interiorly thereof. The developer roller transports a developer mixture comprising carrier granules having toner particles, i.e. marking particles charged triboelectrically, adhering to the surface thereof. As the sleeve rotates, the developer mixture of carrier granules and charged marking particles is transported into contact with the charge pattern recorded on photoconductive surface 12. The charged marking particles are attracted from the carrier granules to the continuously charged area of the charge pattern. After the charge pattern has been developed with both polar or polarizable marking particles and charged marking particles, drum 10 advances the particle image thereon to transfer station D.

At transfer station D, a sheet of support material is moved into contact with the particle image. The sheet of support material is advanced to transfer station D by a sheet feeding apparatus indicated generally by the reference numeral 22. Preferably, sheet feeding apparatus 22 includes a feed roll 24 contacting the uppermost sheet of a stack of sheets 26. Feed roll 24 rotates in the direction of arrow 28 to advance the uppermost sheet into a nip defined by forwarding rollers 30. Forwarding rollers 30 rotate in the direction of arrow 32 to advance the sheet into chute 34. Chute 34 directs the advancing sheet of support material into contact with the photoconductive surface 12 of drum 10 in a timed sequence so that the particle image developed thereon contacts the advancing sheet at transfer station D.

Preferably, transfer station D includes a corona generating device 36 which sprays ions onto the back side of the sheet. This attracts the particle image from photoconductive surface 12 to the sheet. After transfer, the sheet continues to move in the direction of arrow 38 onto a conveyor 40 which advances the sheet to fusing station E.

Fusing station E includes a fuser assembly, indicated generally by the reference numeral 42, which permanently affixes the transferred particle image to the sheet. Preferably, the fuser assembly 42 includes a heated fuser roller 44 and back-up roller 46 with the particle image contacting fuser roller 44. In this manner, the particle image is permanently affixed to the sheet. After fusing, forwarding rollers 48 advance the sheet to catch tray 50 for subsequent removal from the printing machine by the operator.

After the particle image is transferred from photoconductive surface 12 to the copy sheet, drum 10 rotates the photoconductive surface to cleaning station F. At cleaning station F, a cleaning brush removes the residual particles adhering to photoconductive surface 12.

It is believed that the foregoing description is sufficient for purposes of the present invention to illustrate the general operation of an electrophotographic printing machine incorporating the features of the present invention therein.

Figure 2:
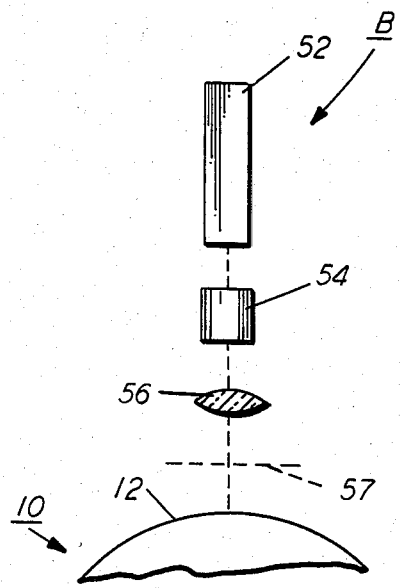
FIG. 2 depicts a laser system which corresponds to one embodiment of the exposure system used in the FIG. 1 printing machine.

Referring now to FIG. 2, there is shown one embodiment of exposure station B. As depicted thereat, exposure station B includes a laser 52 which emits a beam of coherent radiation which is controlled by optic modulator 54. Any suitable computer may be coupled to modulator 54 to provide the required video information thereto in synchronization with the operation of drum 10. The video signal from the computer to modulator 54 may come from any suitable source not only stored computer video signal information but also such information transmitted directly from an electrooptical scanner at a near or remote location. An optical, multiplicative halftone screen 57 modulates the beam of radiation transmitted by modulator 54. When the halftone screen 57 is removed from the optical path, the laser beam is unmodulated and discharges the charge on photoconductive surface 12. In contradistinction, when the halftone screen 57 is in the optical path, the laser beam is modulated. The modulated laser beam selectively discharges the charge on photoconductive surface 12 to record a modulated charge pattern thereon. When the laser beam is turned off, the area of the photoconductive surface 12 remains continuously charged. In this way, the charge pattern recorded on photoconductive surface 12 is a combination of continuously charged and modulated charged areas. Lens 56 serves to expand the laser beam and spot focus it on photoconductive surface 12. A galvanometer optical scanner may be used in conjunction with the foregoing to provide for horizontal laser scanning of the charged region of photoconductive surface 12. Suitable laser systems are described in U.S. Pat. No. 4,012,776 issued to Mrdjen on Mar. 15, 1977; U.S. Pat. No. 4,234,250 issued to Mailloux at al. on Nov. 18, 1980; and U.S. Pat. No. 4,236,809 issued to Kermisch on Dec. 2, 1980, the relevant portions thereof being hereby incorporated into the present application.

Figure 3:
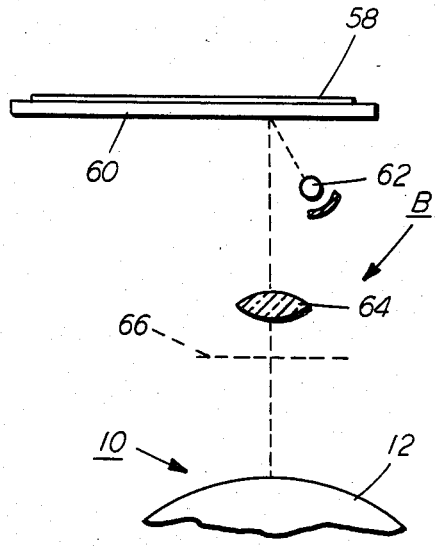
FIG. 3 is an optical system which corresponds to another embodiment of the exposure system used in the FIG. 1 printing machine.

Referring now to FIG. 3, there is shown another embodiment of exposure station B. As depicted thereat, an original document 58 is positioned facedown upon a transparent platen 60. Lamps 62 illuminate the original document with the light rays reflected therefrom being transmitted through lens 64 to form a light image thereof. The light image, in turn, passes through an optical multiplicative halftone screen 66 which is also an optical filter. Screen 66 is, preferably, cyan in color so as to optically filter the red portion of the light image. Thus, screen 66 absorbs the red highlight colors of original document 58. Hence, the highlight regions, i.e. the red regions, of original document 58 are screened while the black regions remain unscreened. In a system of this type, the polar or polarizable marking particles are red and the charged marking particles are black. The screened portion of the light image modulates the charge pattern while the unscreened or solid black region remains unmodulated, i.e. continuously charged. In this way, an original document 58 comprising black information and red highlight information is recorded on the photoconductive surface as continuously charged areas and modulated areas.

Figure 4:
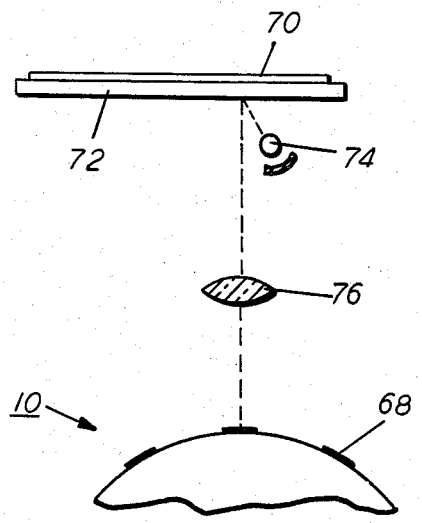
FIG. 4 illustrates another embodiment of the optical system and a modified photoconductive member used in the FIG. 1 printing machine.

Turning now to FIG. 4, there is shown another embodiment of exposure station B. In this latter embodiment, drum 10 comprises a spectrally selective screen layer 68 to provide direct color discrimination from a single exposure. By way of example, drum 10 may comprise a continuous layer of orthochromatic selenium alloy deposited over a finely screened layer of red responsive phthalocyanine or squarylium photogenerator. An original document 70 is positioned facedown upon transparent platen 72. Original document 70 comprises red and black information thereon. Lamps 74 illuminate the original document with the light rays reflected therefrom being transmitted through lens 76 to form a light image thereof. The light image is focused onto the charged portion of the photoconductive surface of drum 10 to selectively dissipate the charge thereon. Screen 68 absorbs the red portion of the light image. In this way, the charge pattern recorded on the photoconductive surface of drum 10 comprises continuously charged areas where it is not exposed at all, i.e. in the black regions of the original document, and high frequency screened charge areas, i.e. modulated charge areas, where it has only been exposed to red. Once again, it is necessary to utilize black charged marking particles and red polar or polarizable marking particles to develop the charge pattern recorded on drum 10.

In recapitulation, it is evident that the electrophotographic printing machine of the present invention records a continuously charged area and a modulated charged area on the photoconductive surface. The modulated charged area is developed with polar or polarizable marking particles while the continuously charged area is developed with charged marking particles. The charged marking particles and polar or polarizable marking particles are of different colors. In this way, a color highlighted copy may be formed in a single pass.

It is, therefore, apparent that there has been provided in accordance with the present invention, an electrophotographic printing machine that fully satisfies the aims and advantages hereinbefore set forth. While this invention has been described in conjunction with specific embodiments and methods of use thereof, it is evident that many alternatives, modifications and variations will be apparent to those skilled in the art. Accordingly, it is intended to cover all such alternatives, modifications and variations as fall within the spirit and broad scope of the appended claims.

What is claimed is:

1. An electrophotographic printing machine of the type having a photoconductive member, including:
   means for recording a modulated charged area and a continuously charged area on the surface of the photoconductive member;
   means for developing the modulated charged area on the surface of the photoconductive member with polar or polarizable marking particles of one color and the continuously charged area on the surface of the photoconductive member with charged marking particles of another color; and
   means for transferring the charged marking particles and the polar or polarizable marking particles to a copy sheet simultaneously to form a color highlighted document.

2. A printing machine according to claim 1, wherein said recording means includes:
   means for charging the surface of the photoconductive member to a substantially uniform level; and
   means for illuminating the charged portion of the surface of the photoconductive member to record a modulated charged area and a continuously charged area thereon.

3. A printing machine according to claim 2, wherein said illuminating means includes a laser beam arranged to be modulated to record the modulated charged area on the surface of the photoconductive member and to be de-energized to record the continuously charged area on the surface of the photoconductive member.

4. A printing machine according to claim 2, wherein said illuminating means includes:
   means for exposing an original document having information in at least two different colors;
   means for receiving the light rays transmitted from the exposed original document to form a light image thereof; and
   means, positioned in the path of the light image being transmitted to the charged portion of the surface of the photoconductive member, for modulating one of the colors of the light image so that the area of the charged portion on the surface of the photoconductive member illuminated by the modulated light image records the modulated charged area and the nonilluminated area of the charged portion of the surface of the photoconductive member records the continuously charged area on the surface of the photoconductive member.

5. A printing machine according to claim 4, wherein said modulating means includes a screen of a color complementary in color to one of the colors in the original document, said screen being positioned in the path of the light image to absorb one color in the information of the original document to record the modulated charged area on the photoconductive surface.

6. A printing machine according to claim 5, wherein said screen is integral with the photoconductive member.

7. A method of electrophotographic printing, including the steps of:
   recording a modulated charged area and a continuously charged area on the surface of a photoconductive member;
   developing the modulated charged area with polar or polarizable marking particles of one color and the continuously charged area on the surface of the photoconductive member with charged particles of another color; and
   transferring the charged marking particles and the polar or polarizable marking particles to a copy sheet simultaneously to form a color highlighted document.

8. A method of printing according to claim 7, wherein said step of recording includes the steps of:
   charging the surface of the photoconductive member to a substantially uniform level; and
   illuminating the charged portion of the surface of the photoconductive member to record a modulated charged area and a continuously charged area thereon.

9. A method of printing according to claim 8, wherein said step of illuminating includes the steps of:
   modulating a laser beam illuminating the charged portion of the surface of the photoconductive member to record the modulated charged area thereon; and
   de-energizing the laser beam illuminating the charged portion of the photoconductive member to record the continuously charged area thereon.

10. A method of printing according to claim 8, wherein said step of illuminating includes the steps of:
   exposing an original document having information in at least two different colors;
   forming a light image of the original document with the light rays received therefrom; and modulating one of the colors in the light image transmitted to the charged portion of the surface of the photoconductive member so that the area of the charged portion of the surface of the photoconductive member illuminated by the modulated light image records the modulated charged area and the non-illuminated region of the charged portion of the surface of the photoconductive member records the continuously charged area of the surface of the photoconductive member.

11. A method according to claim 10, wherein said step of modulating includes the step of positioning a screen of a color complementary in color to one of the colors in the original document in the path of the light image to absorb one color in the information of the original document to record the modulated charged area on the photoconductive surface.

12. The method according to claim 11, wherein the screen is integral with the photoconductive member.

* * * * *